US006604982B1

(12) United States Patent
Croteau-Brooks

(10) Patent No.: US 6,604,982 B1
(45) Date of Patent: Aug. 12, 2003

(54) SUSPENSION DEVICE, SUSPENSION ASSEMBLY INCLUDING SUCH A DEVICE, AND METHOD OF USE

(76) Inventor: Linda Croteau-Brooks, 15 Parkview Dr., N. Smithfield, RI (US) 02896

( * ) Notice: Subject to any disclaimer, the term of this patent is extended or adjusted under 35 U.S.C. 154(b) by 0 days.

(21) Appl. No.: 10/068,126

(22) Filed: Feb. 6, 2002

(51) Int. Cl.[7] ..... A63H 17/26
(52) U.S. Cl. ..... 446/466; 446/465
(58) Field of Search ..... 446/456, 469, 446/454, 448, 465, 466, 470; 280/124.179, 6.15, 6.157

(56) References Cited

U.S. PATENT DOCUMENTS 3,372,512 A * 3/1968 Cremer
3,389,496 A * 6/1968 Cremer
4,602,800 A * 7/1986 Persson ..... 280/6 H
4,696,655 A 9/1987 D'Andrade et al.
4,850,929 A 7/1989 Genevey
4,861,311 A * 8/1989 Alskog ..... 446/469
5,108,126 A 4/1992 Banse
5,306,038 A 4/1994 Henderson, Jr.
5,338,246 A 8/1994 Suto
5,527,059 A * 6/1996 Lee, Jr. ..... 280/688
5,722,872 A 3/1998 Simmons et al.
5,785,576 A 7/1998 Belton
6,478,655 B2 * 11/2002 Wu ..... 446/456

* cited by examiner

*Primary Examiner*—Jacob K. Ackun
*Assistant Examiner*—Jamila Williams
(74) *Attorney, Agent, or Firm*—Salter & Michaelson

(57) ABSTRACT

A suspension device for use with a toy vehicle is provided. The suspension device allows the height of the chassis with respect to the wheels to be quickly and easily adjusted.

19 Claims, 7 Drawing Sheets

SUSPENSION DEVICE, SUSPENSION ASSEMBLY INCLUDING SUCH A DEVICE, AND METHOD OF USE

BACKGROUND

1. Technical Field

The present disclosure is related to a suspension device for a toy vehicle and, in particular, to a suspension device that allows the height of the chassis with respect to the wheels to be adjusted.

2. Related Art

Toy vehicles are quite popular and are typically used on both smooth and rough road surfaces. Many suspension systems are inadequate for allowing the toy vehicle to maneuver well because they have inadequate height to ground clearance. Toy vehicles usually include some type of shock absorbing device such as springs, shock absorbers and the like, but even with such devices, many toy vehicles are simply unable to negotiate rough terrain, or tip over when the road surface becomes too rough. This, of course, can lead to accidental breakage of the toy vehicles, which is expensive to repair.

The patent literature includes many examples of attempts to improve suspension systems of toy vehicles. One example disclosed in U.S. Pat. No. 4,696,655 to D'Andrade et al. is a suspension system formed of corrugated flexible hollow plastic tubes.

U.S. Pat. No. 4,850,929 to Genevey discloses a toy vehicle with an axle made in the form of a stirrup.

U.S. Pat. No. 5,108,126 to Banse discloses a parallelogrammic linkage between the vehicle infrastructure and the wheel mounting member.

Other suspension systems are disclosed in U.S. Pat. No. 5,306,038 to Henderson, U.S. Pat. No. 5,338,246 to Suto, U.S. Pat. No. 5,722,872 Simmons et al., and U.S. Pat. No. 5,785,576 to Belton.

None of the foregoing suspension systems allows the height of the chassis with respect to the wheels to be adjustably varied relatively quickly and in a reliable manner.

SUMMARY

In one embodiment, the present disclosure is directed to a suspension device for a toy vehicle having a chassis, a suspension assembly, and wheels. The suspension device includes a frame having a base member and first and second opposing side members supported on the base member. The suspension device also includes at least two notch pairs. Each notch pair includes a first notch disposed on the first side member and a second notch disposed on the second side member opposite the first side member. Each of the first and second notches of each notch pair may be configured and dimensioned to selectively engage a member of the suspension assembly. The distance between the chassis and the wheels is selectively adjustable by engaging a member of the suspension assembly with a selected notch pair.

In another embodiment, the present disclosure is directed to a suspension assembly for a toy vehicle having a chassis. The suspension assembly includes a suspension device supported on the chassis. The suspension device includes at least two notch pairs. Each notch pair includes a first notch disposed on the first side member and a second notch disposed on the second side member opposite the first side member. Each of the first and second notches of each notch pair may be configured and dimensioned to selectively engage a member of the suspension assembly. At least one wheel support member maybe operatively connected to the chassis. At least one shock absorber may be supported by the wheel support member and operatively connected to the suspension device. At least one bushing assembly may be operatively connected to the shock absorber and adapted to be selectively received within the suspension device. When a member of the bushing assembly is received within a first selected pair of notches, the chassis is a first selected distance from the wheels. When the member of the bushing assembly is received within a second selected pair of notches that is different from the first selected pair of notches, the chassis is a second selected distance from the wheels. The second selected distance is preferably being different from the first.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

The present disclosure is directed to a suspension device for a toy vehicle which allows a user to quickly and easily adjust or vary the height of the chassis with respect to the wheels. By increasing the distance between the chassis and the wheels, the ability to negotiate smooth, rough or uneven terrain is improved.

Figure 1:
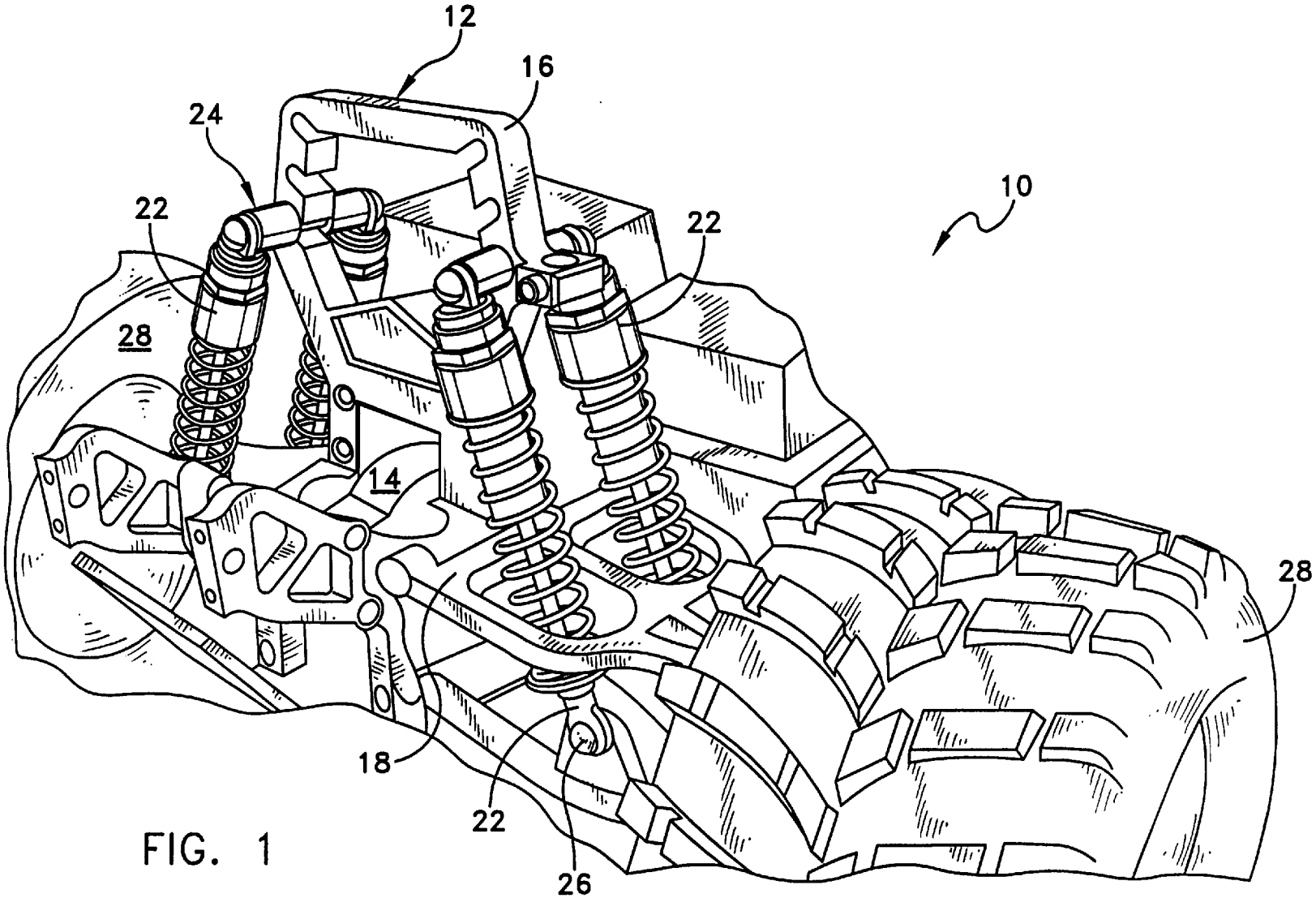
FIG. 1 is a perspective view of a portion of a toy vehicle that includes suspension assembly and a suspension device according to the present disclosure.

FIG. 1 is a partial view of an exemplary toy vehicle 10 which includes a suspension assembly 12 and a chassis 14. Suspension assembly 12 preferably includes a suspension device 16, at least one wheel support member 18, at least one shock absorber 22, and a bushing assembly indicated generally at 24. Preferably, suspension device 16 may be connected to chassis 14 as discussed in greater detail below. Also preferably, each shock absorber 22 maybe connected to suspension device 16 by a bushing assembly 24, and to wheel support member 18 by a fastener 26. In the present embodiment, a wheel 28 may be supported by each wheel support member 18 by supporting wheel 28 at its center (not illustrated).

Figure 2:
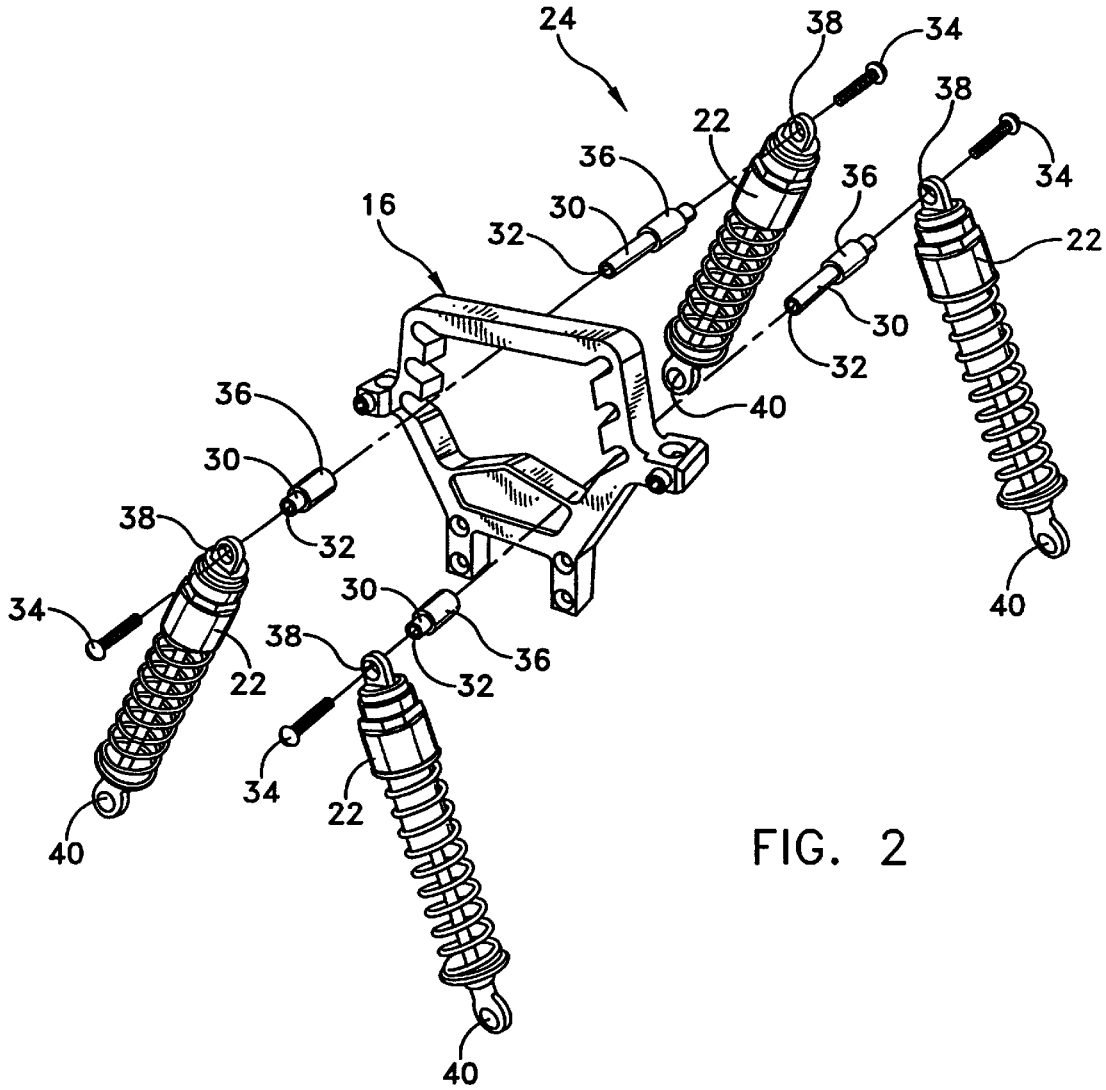
FIG. 2 is an exploded perspective view of a portion of the suspension assembly of the toy vehicle shown in FIG. 1.
Figure 3:
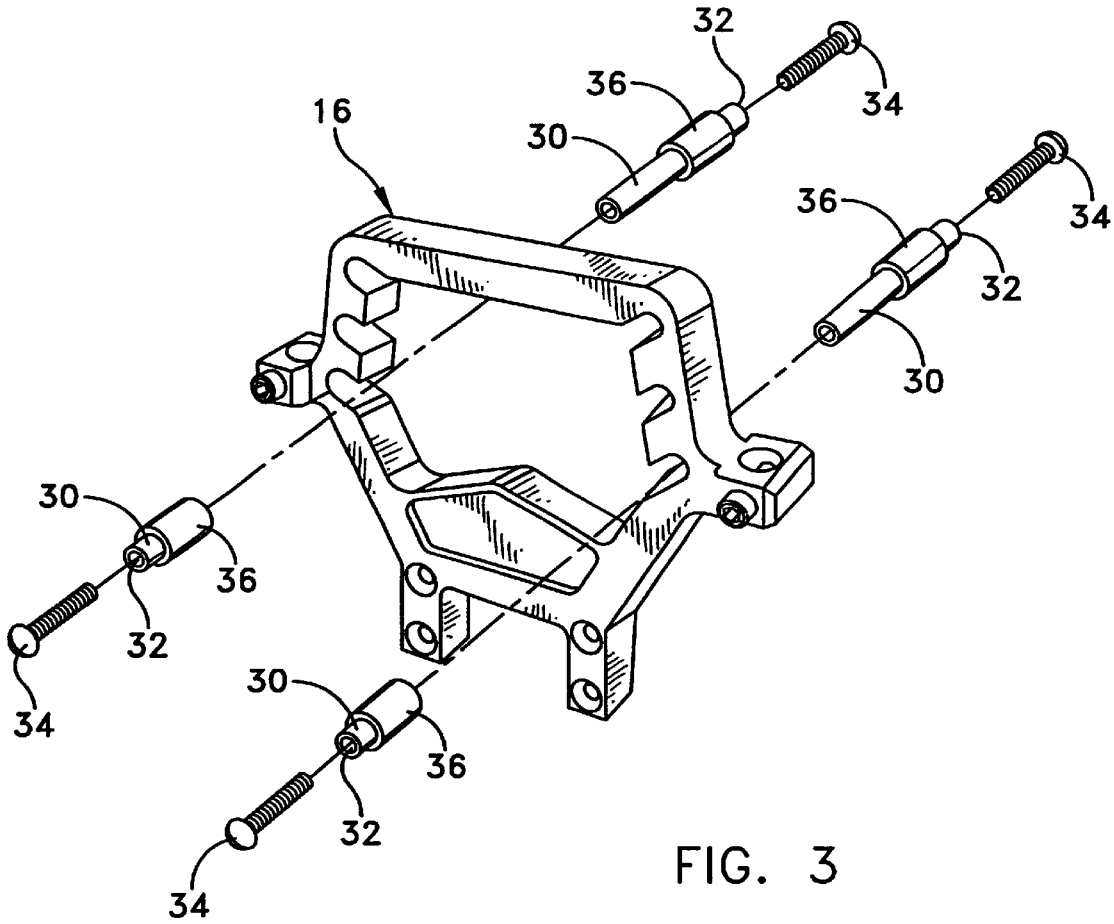
FIG. 3 is an exploded perspective view of the suspension device and bushing assembly shown in FIG. 2.

FIGS. 2 and 3 show shock absorbers 22, bushing assemblies 24, and suspension device 16 in exploded view. As shown, each bushing assembly 24 preferably includes a shaft 30 having a threaded interior end surface 32 for receiving an end cap 34 which, in the present embodiment, is an externally threaded screw. A bushing 36 may be disposed on each shaft 30, preferably in fixed relation to shaft 30. Each shaft 30 may be adapted to receive a shock absorber 22 between bushing 36 and end cap 34. Each shock absorber 22 includes a first aperture 38 into which shaft 30 may be slidably received, for connecting shock absorber 22 to suspension device 16. Shock absorbers 22 also each include a second aperture 40 for receiving fastener 26 to connect shock absorber 22 to wheel support member 18.

Figure 4:
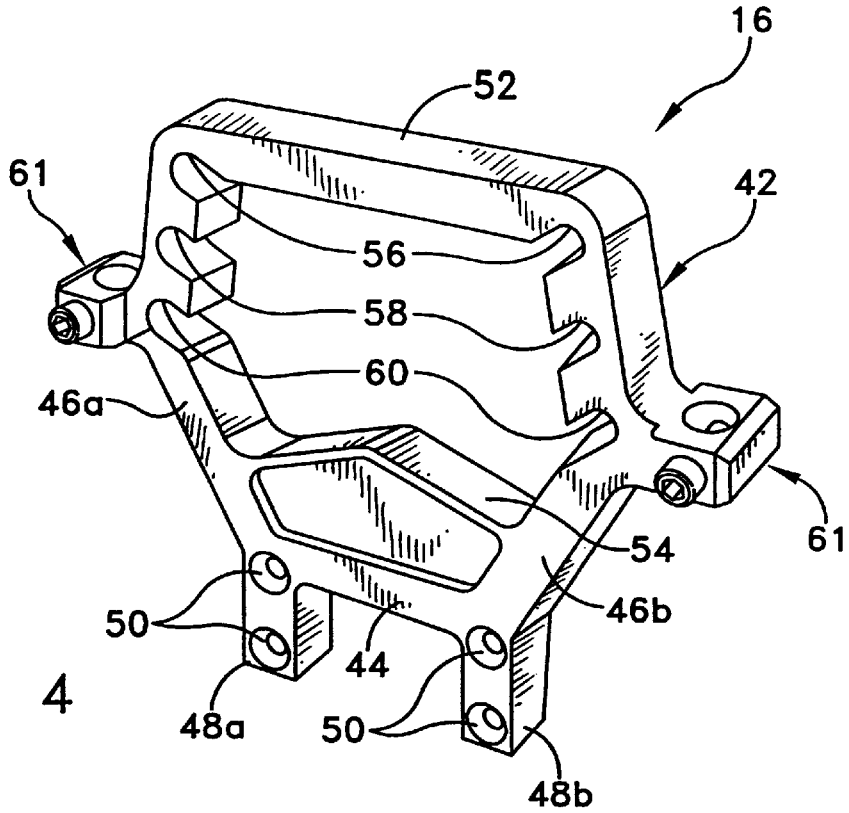
FIG. 4 is a perspective view of the suspension device shown in FIG. 3.
Figure 5:
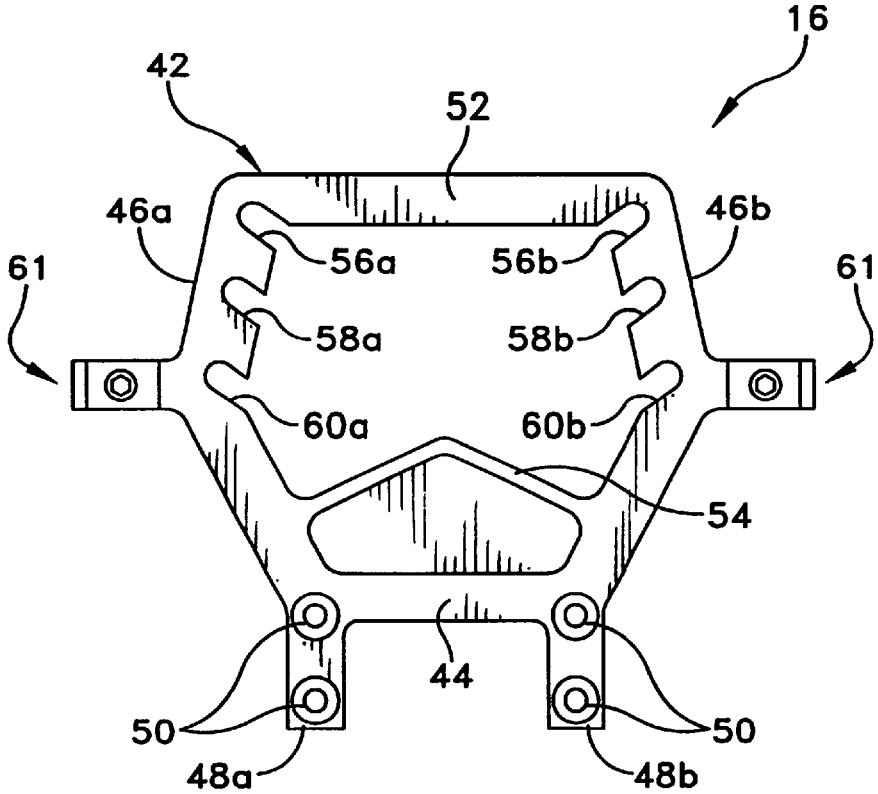
FIG. 5 is a front view of the suspension device of FIG. 3.

Suspension device 16 is shown in greater detail in FIGS. 4–5, when taken together. As shown, suspension device 16 preferably has a substantially symmetrical frame 42 including a base 44 and opposing side members 46*a,b*. In the present embodiment, suspension device 16 preferably includes a pair of connecting posts 48*a,b* extending downwardly from base 44. Preferably, each connecting post 48*ab* includes at least one aperture 50 for receiving fastener 26 (see FIG. 1). In this manner, frame 42 may be connected to chassis 14. Those of ordinary skill in the art will recognize that any suitable fastener may be used, such as a screw or rivet. In the present embodiment, fastener 26 is an externally threaded screw.

If additional structural reinforcement is desired or necessary during use of the vehicle, it may be provided by including, for example, a header 52 and/or a reinforcing bar 54 extending between opposing side members 46*a,b*, as shown in the present embodiment. Body mounts 61, which are known in the art, may be included on the suspension device 16 as well.

Suspension device 16 also includes three spaced apart notch pairs 56, 58, 60. As shown in FIG. 5, notch pair 56 includes a first notch 56*a* positioned on first side member 46*a*, opposite a second notch 56*b* positioned on the opposing second side member 46*b*. Similarly, notch pairs 58, 60 each include first notches 58*a*, 60*a* positioned on first side member 46*a*, opposite second notches 58*b*, 60*b* positioned on the opposing second side member 46*b*. Preferably, first and second notches 56*a,b* of first notch pair 56 may be positioned substantially equidistantly from base 44. Similarly, it is preferred that first and second notches 58*a,b* of second notch pair 58, and first and second notches 60*a,b* of third notch pair 60, also may be positioned substantially equidistantly from base 44.

Figure 6:
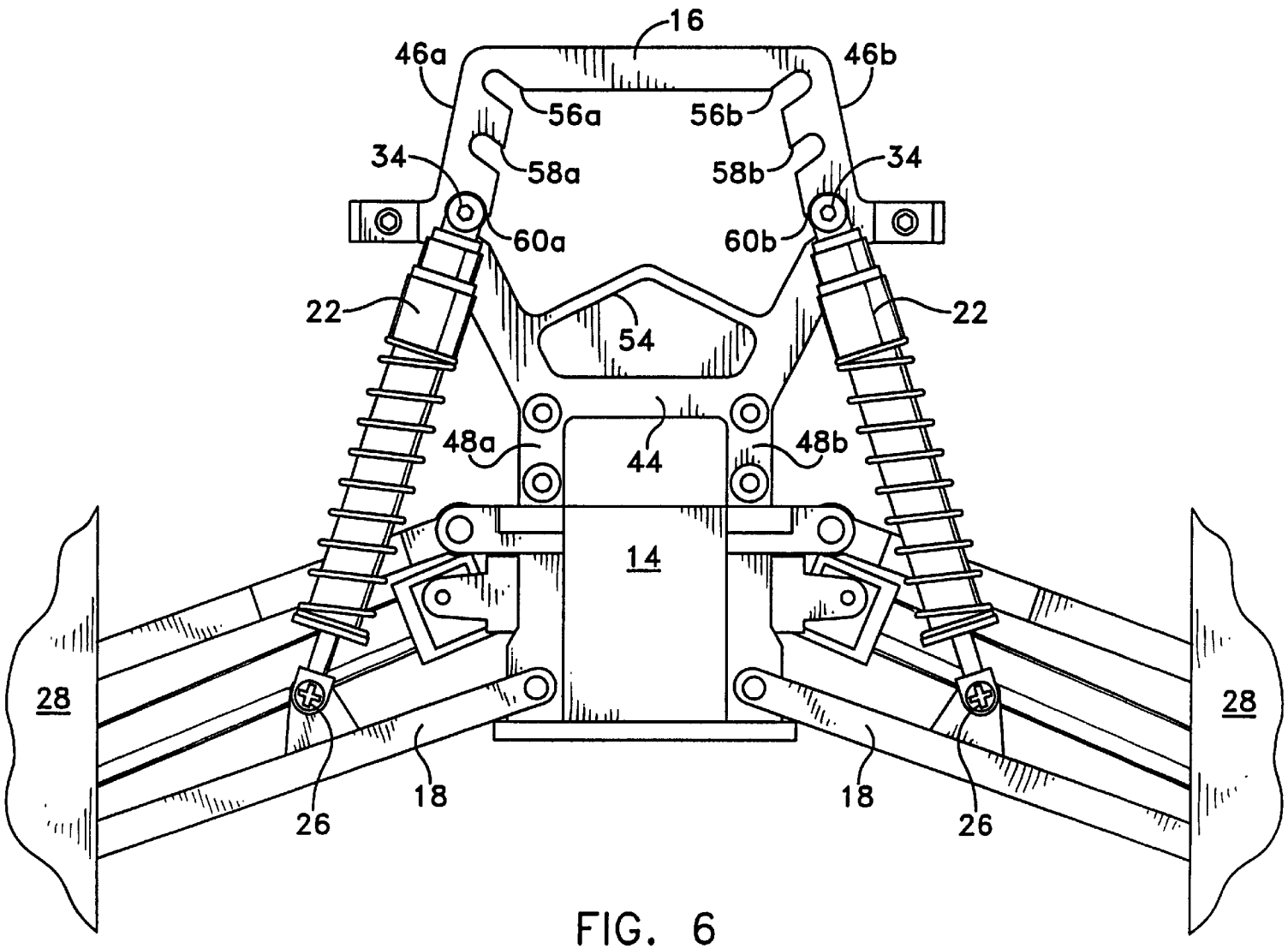
FIG. 6 is a front view of the chassis in its uppermost position with respect to the wheels.
Figure 7:
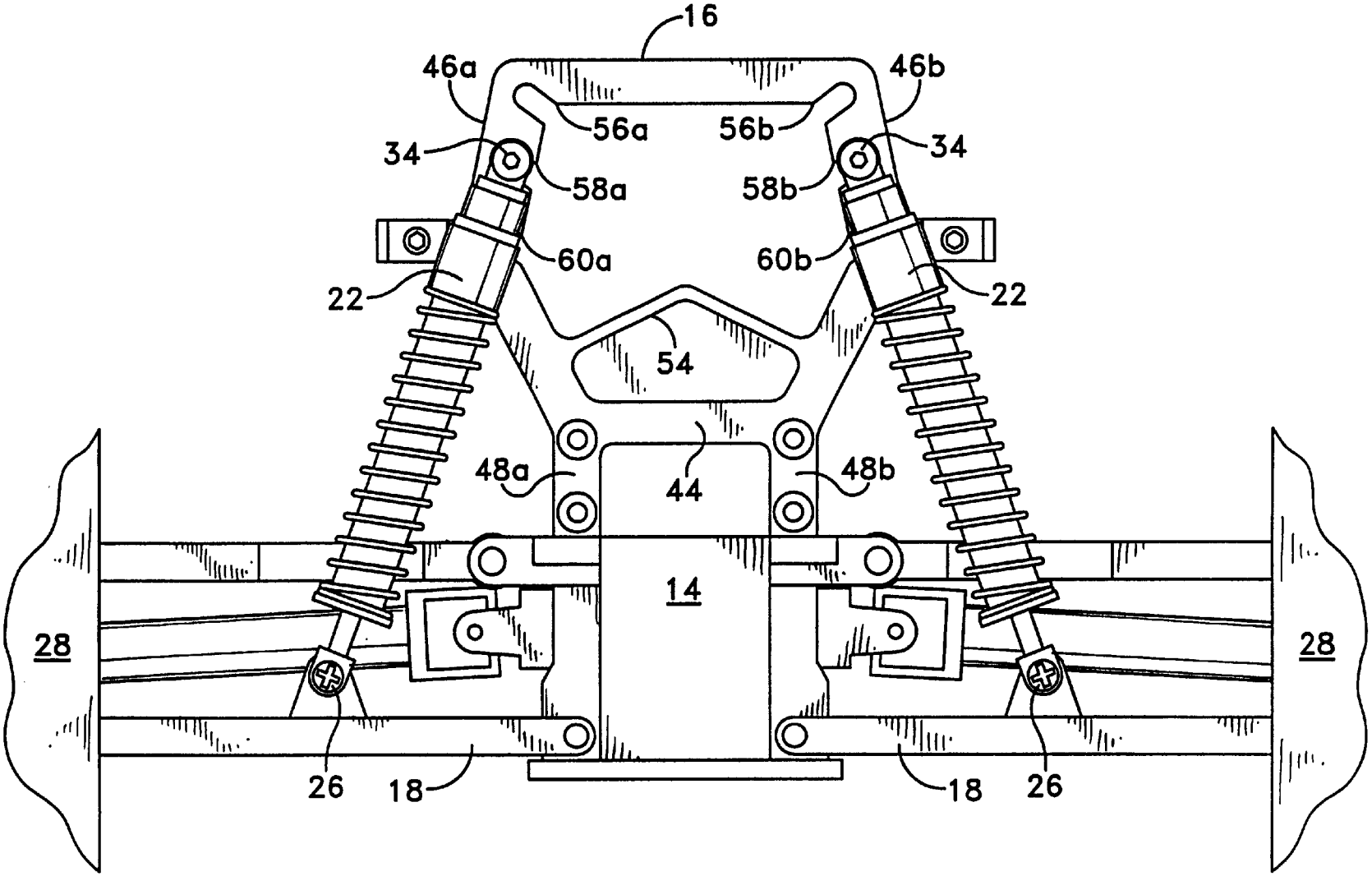
FIG. 7 is a perspective view of the chassis in an intermediate position with respect to the wheels.
Figure 8:
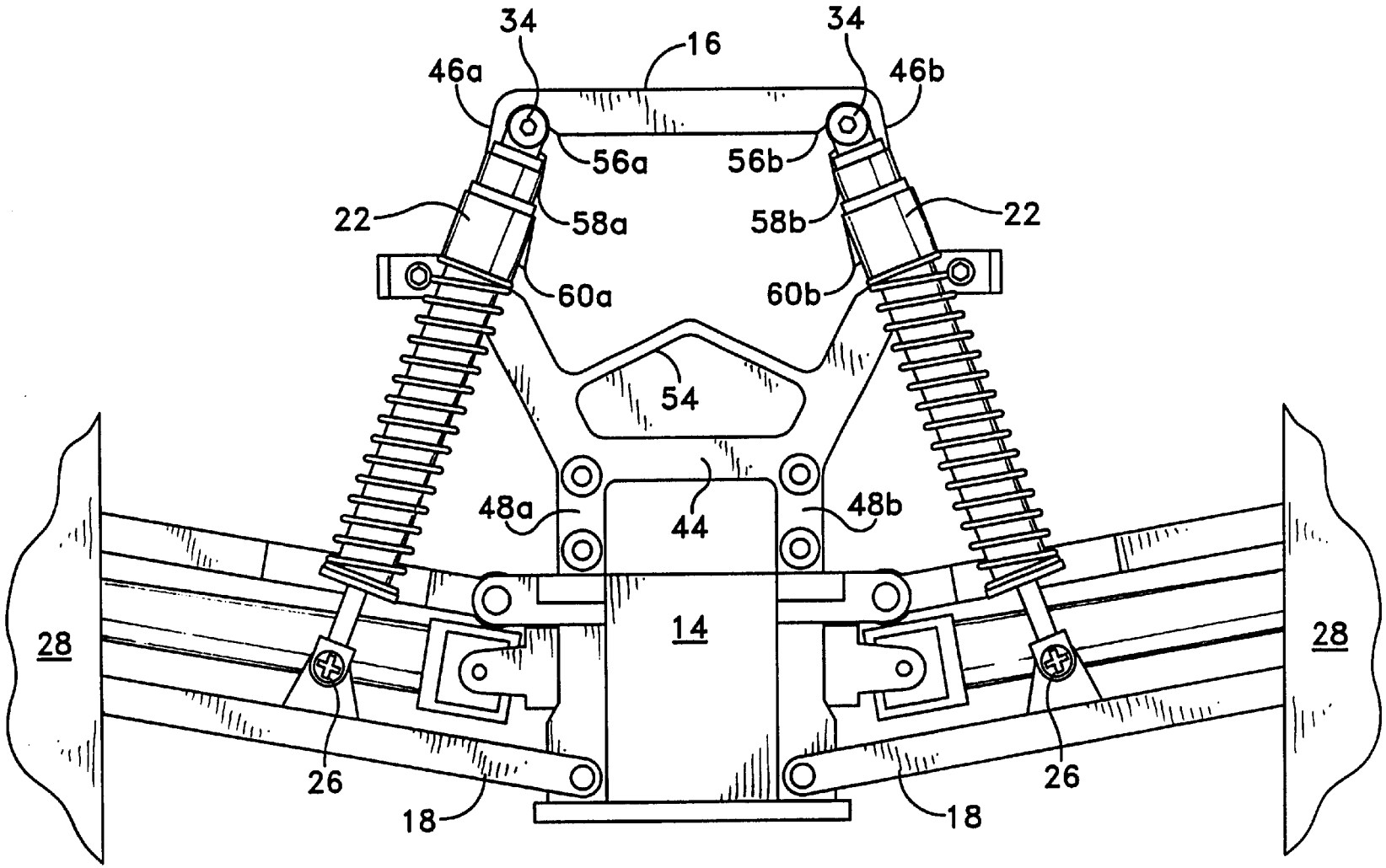
FIG. 8 is a front view of the chassis in its lowermost position with respect to the wheels.

As shown in FIGS. 6–8 when taken together, suspension device 16 preferably may be connected to chassis 14 of vehicle 10 using fasteners 26 inserted into apertures 40 of shock absorbers 22. Shock absorbers 22 may be connected to wheel supports 18 at apertures 40 using any type of fastener. Those of ordinary skill in the art will recognize that any suitable fastener may be used, such as a screw or rivet. Shafts 30 of bushing assemblies 24 may be slidably received into one selected notch pair 56, 58, 60 and fixed in position in the selected notch pair by securing end cap 34 into ends 32 of shafts 30.

FIG. 6 shows a front view of toy vehicle 10 with the greatest distance between chassis 14 and the ground (not illustrated). As shown, shaft 30 of bushing assembly 24 may be slidably inserted into notches 60*a,b* of notch pair 60 of suspension device 16. Thus, in the present embodiment, the engagement of shafts 30 with notches 60*a,b* represents the uppermost position of chassis 14 with respect to the center of each wheel 28 and the greatest distance between chassis 14 and the ground.

To change the ground clearance of chassis 14, a user may use an appropriate tool (not illustrated), such as a screwdriver or an allen wrench, to loosen end cap 34 from shafts 30 sufficiently to be able to remove shafts 30 from notches 60*a,b*. Once removed, shafts 30 are repositioned in another selected notch pair and end caps 34 once again may be secured into shafts 30.

FIG. 7 shows a front view of toy vehicle 10 with the chassis 14 at an intermediate distance between chassis 14 and the ground. As shown, shafts 30 are inserted in notches 58*a,b* of notch pair 58 of suspension device 16. Thus, in the present embodiment, the engagement of shafts 30 with notch pair 58 represents an intermediate position in which chassis 14 may be substantially parallel to the center of wheels 28, and in which chassis 14 is an intermediate distance to the ground.

FIG. 8 shows a front view of toy vehicle 10 with the least distance between chassis 14 and the ground. As shown, shafts 30 are inserted into notches 56*a,b* of notch pair 56 of suspension device 16. Thus, in the present embodiment, the engagement of shafts 30 with notches 56*a,b* of notch pair 56 represents the lowermost position of chassis 14 with respect to the center of wheels 28 and the least distance between chassis 14 and the ground.

Although particular embodiments of the disclosure have been described in detail for purposes of illustration, various changes and modifications may be made without departing from the scope and spirit of the disclosure. For example, suspension device 16 may include less than or more than three notch pairs in order to provide further incremental adjustments of the distance of the chassis with respect to the wheels. Other applications for which the suspension device may be used or adapted include recreational sports vehicles, motorcycles, bicycles, and the like. Accordingly, the disclosure is not to be limited except as by the appended claims.

What is claimed is:

1. In combination:

a toy vehicle comprising:

a chassis, a suspension assembly, and wheels, and a suspension device comprising:

a frame having a base member, and first and second opposing side members supported on the base member;

at least two notch pairs, each notch pair including a first notch disposed on the first side member and a second notch positioned on the second side member opposite the first side member, each of the first and second notches of each notch pair being configured and dimensioned to selectively engage a member of the suspension assembly;

wherein a distance between the chassis and the wheels is selectively adjustable by engaging a member of the suspension assembly with a selected notch pair.

2. The combination of claim 1, wherein the suspension device further includes at least one reinforcing member extending between each of the opposing side members.

3. The combination of claim 1, wherein the frame of the suspension device further includes at least one post member extending from the base member of the frame.

4. The combination of claim 3, wherein each of the at least one post members includes a bore for receiving a fastener for connecting the post to the chassis of the toy vehicle.

5. The combination of claim 2, wherein the at least one reinforcing member is a header.

6. The combination of claim 1, wherein the at least two notch pairs are disposed on an inner surface of the first and second side members.

7. The combination of claim 1, wherein the first and second notches of each notch pair are positioned substantially equidistantly from the base member.

8. A suspension assembly for a toy vehicle having a chassis, comprising:

a suspension device supported on the chassis, the suspension device including at least two notch pairs, each notch pair including a first notch disposed on the first side member and a second notch positioned on the second side member opposite the first side member, each of the first and second notches of each notch pair being configured and dimensioned to selectively engage a member of the suspension assembly;

at least one wheel support member operatively connected to the chassis;

at least one shock absorber supported by the wheel support member and operatively connected to the suspension device;

at least one bushing assembly operatively connected to the shock absorber and adapted to be selectively received within the suspension device;

wherein, when a member of the bushing assembly is received within a first selected pair of notches, the chassis is a first selected distance from the wheels, and when the member of the bushing assembly is received within a second selected pair of notches that is different from the first selected pair of notches, the chassis is a second selected distance from the wheels, the second selected distance being different from the first.

9. The suspension assembly of claim 8, wherein the bushing assembly further includes a shaft, the shaft being slidably received into the suspension device.

10. The suspension assembly of claim 9, wherein the bushing assembly includes a bushing slidably mounted on the shaft, the shock absorber being received onto the shaft adjacent the bushing.

11. The suspension assembly of claim 10, wherein the suspension device comprises a frame that includes a plurality of notch pairs for slidably receiving the shaft.

12. The suspension assembly of claim 10, wherein the first and second notches of each notch pair are substantially equidistant from the chassis.

13. In combination:

a toy vehicle, the toy vehicle comprising:

a chassis;

a suspension assembly; and at least two wheel axles; and a suspension device, the suspension device comprising:

a frame having a base member parallel to the at least two wheel axles, and first and second opposing side members extending from the base member in a vertical direction;

at least two spaced apart notch pairs, each notch pair including a first notch disposed on the first side member and a second notch positioned on the second side member opposite the first side member, each of the first and second notches of each notch pair being spaced apart in a vertical direction;

wherein, when a member of the suspension assembly is engaged in a selected notch pair, the chassis is a first distance from the wheels, and when the member of the suspension assembly is engaged with a second notch pair, different from the first notch pair, the chassis is a second distance from the wheels, the second distance being different from the first distance.

14. The suspension device combination of claim 13, further comprising wherein the suspension device further includes at least one reinforcing member extending between each of the opposing side members.

15. The suspension device combination of claim 13, wherein the frame of the suspension device further includes at least one post member extending from the base member of the frame.

16. The suspension device combination of claim 13, wherein each of the at least one post members includes a bore for receiving a fastener for connecting the post to the chassis of the toy vehicle.

17. The suspension device combination of claim 14, wherein the at least one reinforcing member is a header.

18. The suspension device combination of claim 13, wherein the at least two notch pairs are disposed on an inner surface of the first and second side members.

19. The suspension device combination of claim 13, wherein the first and second notches of each notch pair are positioned substantially equidistantly from the base member.

* * * * *